US012000115B2

(12) United States Patent
Katayama et al.

(10) Patent No.: US 12,000,115 B2
(45) Date of Patent: Jun. 4, 2024

(54) HYDRAULIC EXCAVATOR

(71) Applicant: HITACHI CONSTRUCTION MACHINERY CO., LTD., Tokyo (JP)

(72) Inventors: Saito Katayama, Tsuchiura (JP); Kazuhiko Mizoguchi, Ishioka (JP); Hidenobu Tsukada, Ushiku (JP); Keiichirou Nakamura, Mito (JP); Shinichi Sasazaki, Tsuchiura (JP); Naoki Hagiwara, Kasumigaua (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 598 days.

(21) Appl. No.: 17/276,585

(22) PCT Filed: Oct. 10, 2019

(86) PCT No.: PCT/JP2019/040110

§ 371 (c)(1),
(2) Date: Mar. 16, 2021

(87) PCT Pub. No.: WO2020/080264

PCT Pub. Date: Apr. 23, 2020

(65) Prior Publication Data

US 2022/0042285 A1 Feb. 10, 2022

(30) Foreign Application Priority Data

Oct. 15, 2018 (JP) ..... 2018-194653

(51) Int. Cl.
*E02F 9/26* (2006.01)
*E02F 9/12* (2006.01)
(Continued)

(52) U.S. Cl.
CPC ..... *E02F 9/261* (2013.01); *E02F 9/123* (2013.01); *E02F 9/2004* (2013.01); *E02F 9/2285* (2013.01); *E02F 9/2296* (2013.01)

(58) Field of Classification Search
CPC ..... B65G 43/08; B65G 2201/045
See application file for complete search history.

(56) References Cited

U.S. PATENT DOCUMENTS 8,833,068 B2 9/2014 Himoto et al.
2014/0190159 A1 7/2014 Tajima et al.
(Continued)

FOREIGN PATENT DOCUMENTS

JP 2001-032332 A 2/2001
JP 2010-101068 A 5/2010
(Continued)

OTHER PUBLICATIONS

International Search Report of PCT/JP2019/040110 dated Nov. 26, 2019.
(Continued)

*Primary Examiner* — Jaime Figueroa
*Assistant Examiner* — Jerrod Irvin Davis
(74) *Attorney, Agent, or Firm* — MATTINGLY & MALUR, PC

(57) ABSTRACT

A hydraulic excavator includes a plurality of cameras that are attached to an upper swing structure and photograph images of surroundings, a controller configured to detect an obstacle present around the upper swing structure on the basis of the camera images, and a speaker that makes a notification that the obstacle is detected when the controller detects the obstacle. When a lock lever is at a lock release position and control levers are maintained in a non-operating state from a time of a start of the controller, the controller permits the notification by the speaker. When the lock lever is at the lock release position and the control levers are changed from an operating state to a non-operating state, the controller permits the notification by the speaker when the non-operating state is continued for a predetermined time or more.

6 Claims, 10 Drawing Sheets

(51) Int. Cl.
*E02F 9/20* (2006.01)
*E02F 9/22* (2006.01)

(56) References Cited

U.S. PATENT DOCUMENTS

| | | | | |
|---|---|---|---|---|
| 2017/0073937 | A1 | 3/2017 | Itoga et al. | |
| 2018/0080198 | A1* | 3/2018 | Machida | E02F 9/24 |
| 2018/0209122 | A1 | 7/2018 | Kiyota et al. | |
| 2019/0194913 | A1* | 6/2019 | Petrany | E02F 9/205 |

FOREIGN PATENT DOCUMENTS

| | | | |
|---|---|---|---|
| JP | 2013-144906 | A | 7/2013 |
| JP | 2014-134015 | A | 7/2014 |
| JP | 2015-001071 | A | 1/2015 |
| JP | 2017-203253 | A | 11/2017 |
| WO | 2012/053105 | A1 | 4/2012 |
| WO | 2017/094627 | A1 | 6/2017 |

OTHER PUBLICATIONS

Korean Office Action received in corresponding Korean Application No. 10-2021-7004783 dated Jul. 18, 2022.
International Preliminary Report on Patentability received in corresponding International Application No. PCT/JP2019/040110 dated Apr. 29, 2021.

* cited by examiner

HYDRAULIC EXCAVATOR

TECHNICAL FIELD

The present invention relates to a hydraulic excavator that can detect an obstacle present around the hydraulic excavator on the basis of a camera image.

BACKGROUND ART

Some hydraulic excavators include a periphery monitoring system that detects an obstacle around an upper swing structure by a camera, a millimeter-wave radar, or the like, and when an obstacle is detected, notifies an operator by a monitor (display device) or an alarm device that the obstacle is detected.

Patent Document 1, for example, discloses a hydraulic excavator that includes a camera and a display device, calculates relative positions of obstacles and the excavator, the obstacles being detected by use of a camera image, calculates a hazard zone on a periphery of the excavator on the basis of a posture and an operation of the excavator, sets contact risk levels to the obstacles present within the hazard zone, converts the camera image into a bird's-eye image in which the excavator is located in a center of the bird's-eye image, generates an image including the excavator and the whole of the hazard zone, the image overlooking the bird's-eye image from a viewpoint set above an obstacle to which a highest contact risk level is set, and displays the generated image on the display device.

PRIOR ART DOCUMENT

Patent Document

Patent Document 1: International Publication No. WO 2012/53105

SUMMARY OF THE INVENTION

Problem to be Solved by the Invention

A hydraulic excavator including a periphery monitoring system as described above may stop an obstacle notifying function using a monitor and an alarm device under certain conditions. When the hydraulic excavator is being operated by an operation of an operator or the hydraulic excavator is moving due to inertia or the like even in a non-operating state at the time of restoring the notifying function thus stopped temporarily for the purpose of resumption of work or the like, there is a possibility of generating an unnecessary notification due to a movement of the hydraulic excavator even if there is no obstacle present around the hydraulic excavator, so that the operator may feel annoyed.

The present invention has been made in view of the above circumstances. It is an object of the present invention to provide a hydraulic excavator that can reduce unnecessary notifications due to the movement of the hydraulic excavator.

Means for Solving the Problem

The present application includes a plurality of means for solving the above problem. To cite an example of the means, there is provided a hydraulic excavator including a lower track structure, an upper swing structure swingably attached to an upper portion of the lower track structure, a front work device attached to the upper swing structure, an operation device that operates operation targets including the lower track structure, the upper swing structure, and the front work device, a lock lever switched to one of a lock position that disables an operation of the operation targets by the operation device and a lock release position that permits the operation of the operation targets by the operation device, a camera that is attached to the upper swing structure and records an image of surroundings of the upper swing structure, a controller configured to detect an obstacle present around the upper swing structure on a basis of the image, and a notifying device that makes a notification that the obstacle is detected when the controller detects the obstacle. The controller is configured to permit the notification by the notifying device when the lock lever is at the lock release position and the operation device is maintained in a non-operating state from a time of a start of the controller and, when the lock lever is at the lock release position and the operation device is changed from an operating state to a non-operating state, permit the notification by the notifying device when the non-operating state is continued for a predetermined time.

Advantage of the Invention

According to the present invention, unnecessary notifications due to the movement of the hydraulic excavator can be reduced, and therefore annoyance caused to an operator can be reduced.

MODE FOR CARRYING OUT THE INVENTION

An embodiment of the present invention will hereinafter be described with reference to the drawings.

It is to be noted that while a hydraulic excavator having a bucket as a work tool (attachment) at a distal end of a work device will be illustrated as a work machine in the following, the present invention may be applied to work machines having an attachment other than a bucket. In addition, application to work machines other than the hydraulic excavator is also possible as long as the work machines have an articulated work device formed by coupling a plurality of link members (an attachment, a boom, an arm, and the like) to each other.

In addition, in the following description, when there are a plurality of identical constituent elements, alphabetic capital letters may be attached to ends of reference symbols. However, the plurality of constituent elements may be denoted collectively with the alphabetic capital letters omitted. For example, when there are three identical pumps 190*a*, 190*b*, and 190*c*, these pumps may be denoted collectively as pumps 190.

Figure 1:
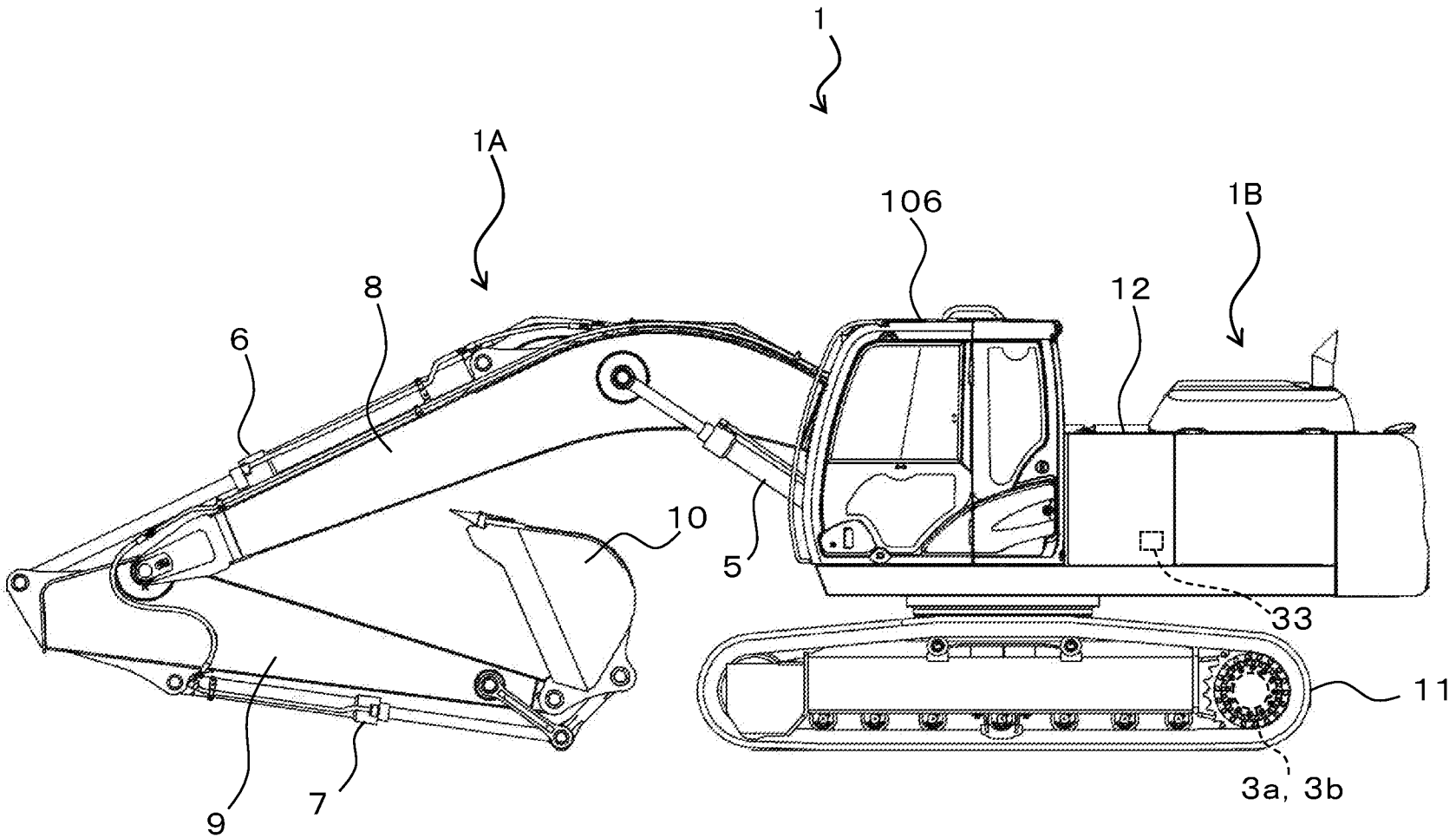
FIG. 1 is a side view of a hydraulic excavator 1 according to an embodiment of the present invention.
Figure 2:
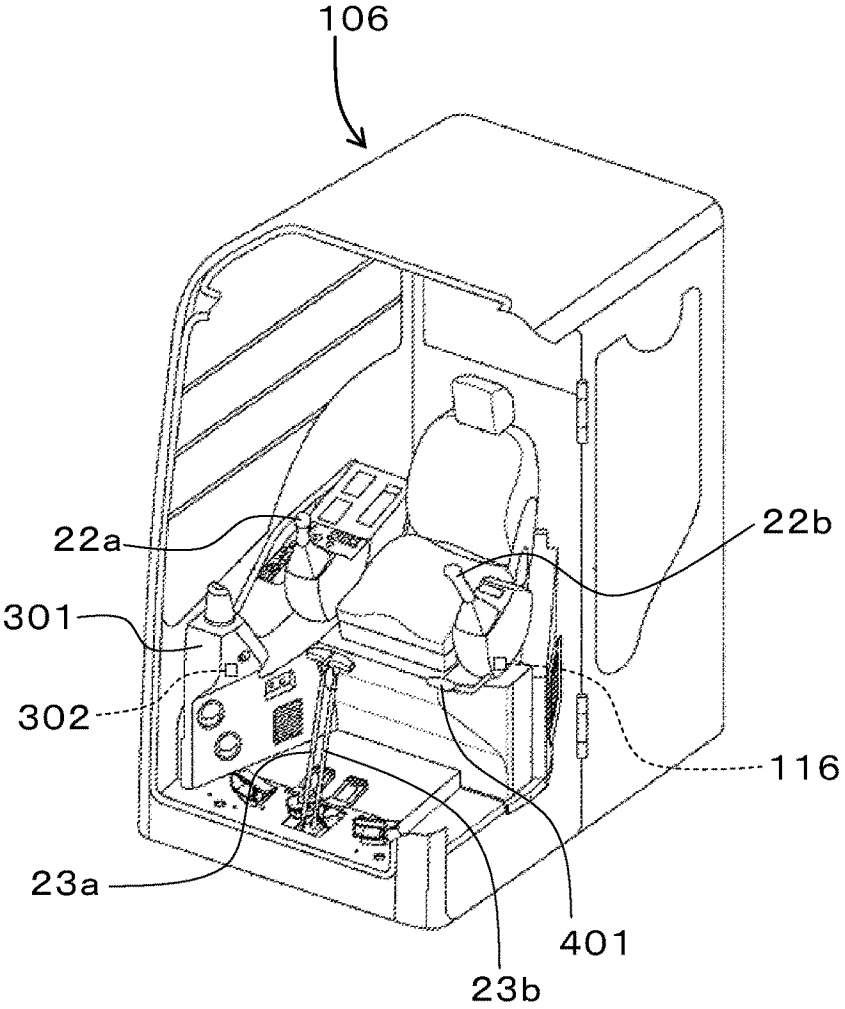
FIG. 2 is a perspective view of an inside of a cab 106 of the hydraulic excavator 1 according to the embodiment of the present invention.
Figure 3:
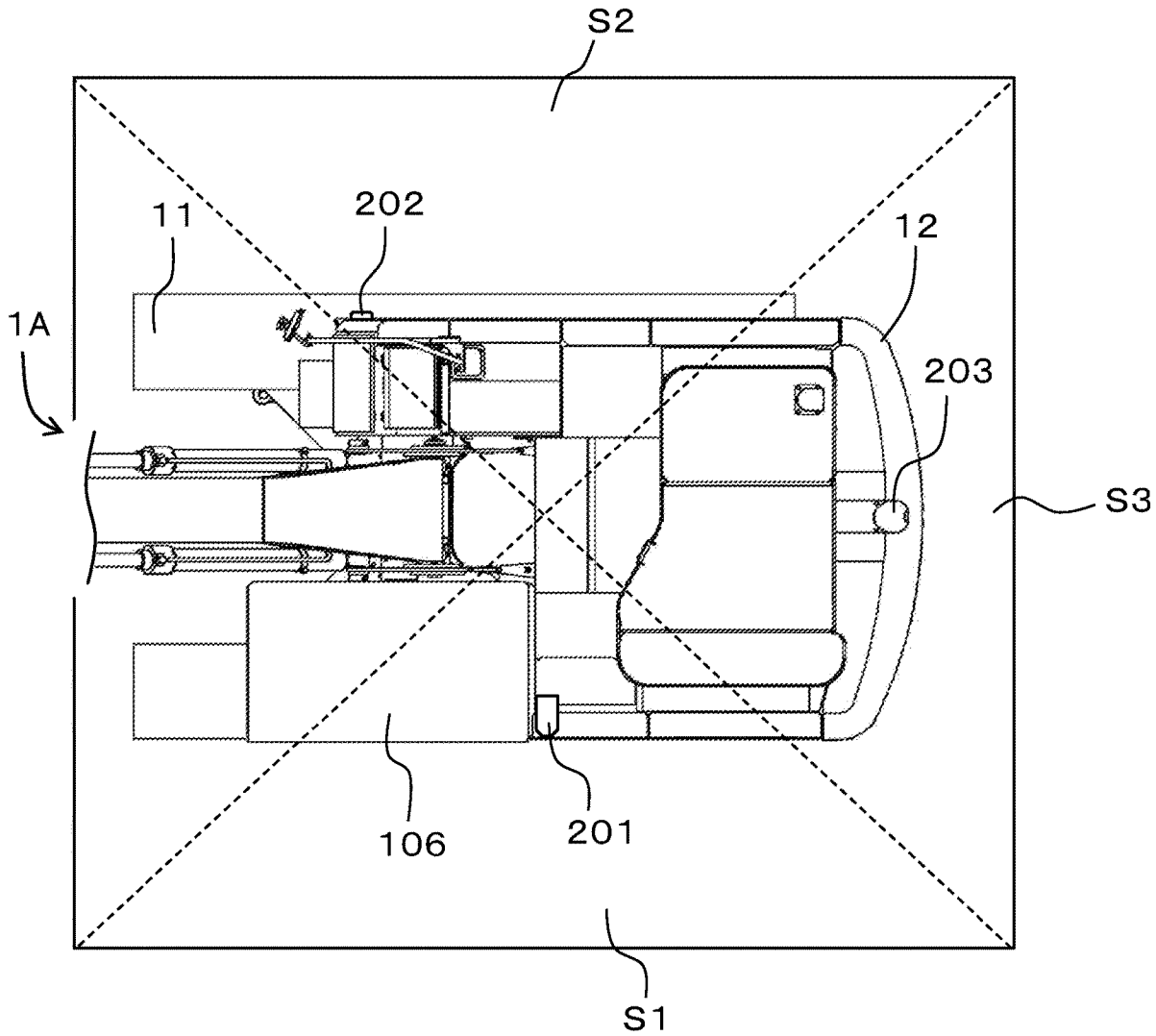
FIG. 3 is a top view of the hydraulic excavator 1 according to the embodiment of the present invention.
Figure 4:
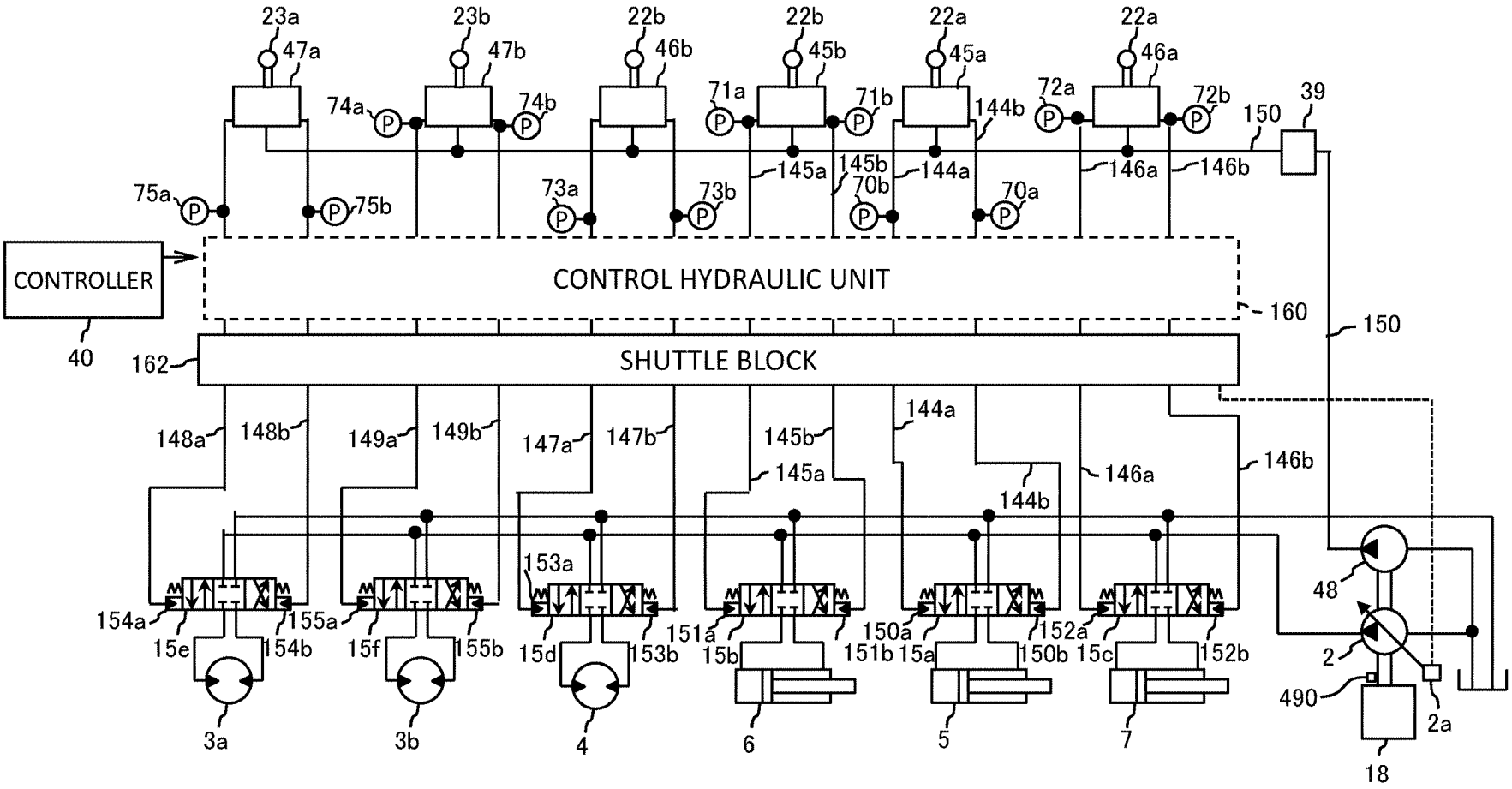
FIG. 4 is a schematic diagram of a hydraulic drive system in the hydraulic excavator 1 according to the embodiment of the present invention.

FIG. 1 is a configuration diagram of a hydraulic excavator 1 according to the embodiment of the present invention. FIG. 2 is an internal configuration diagram of a cab 106 in the hydraulic excavator 1. FIG. 3 is a bird's-eye view of the hydraulic excavator 1, the bird's-eye view illustrating attachment positions of cameras attached to the hydraulic excavator 1 and angles of view of the cameras. FIG. 4 is a diagram illustrating a hydraulic drive system of the hydraulic excavator 1 together with a controller 40. Incidentally, in each figure, the same parts are identified by the same reference symbols.

In FIG. 1, the hydraulic excavator 1 includes an articulated front work device 1A and a machine body (machine main body) 1B. The machine body (machine main body) 1B includes a lower track structure 11 travelling by crawlers driven by left and right travelling hydraulic motors 3*a* and 3*b* and an upper swing structure 12 capable of swinging left and right, the upper swing structure 12 being attached to an upper portion of the lower track structure 11 and driven by a swing hydraulic motor 4 (see FIG. 4).

The front work device 1A is formed by coupling a plurality of front implement members (a boom 8, an arm 9, and a bucket 10) that each rotate in a vertical direction. A proximal end of the boom 8 is rotatably supported in a front portion of the upper swing structure 12 via a boom pin. A proximal end of the arm 9 is rotatably coupled to a distal end of the boom 8 via an arm pin. A proximal end of the bucket 10 is rotatably coupled to a distal end of the arm 9 via a bucket pin. The boom 8 is driven by a boom cylinder 5. The arm 9 is driven by an arm cylinder 6. The bucket 10 is driven by a bucket cylinder 7.

As a speed sensor (swing speed measuring sensor) for detecting the speed of the upper swing structure 12, an IMU (Inertial Measurement Unit) 33 is attached to the upper swing structure 12.

In addition, as illustrated in the top view of FIG. 3, as cameras for photographing images (video) of surroundings of the hydraulic excavator 1, a left side camera 201, a right side camera 202, and a rear camera 203 are installed on the upper swing structure 12. The left side camera 201 is to photograph an image of a left side region S1 of the upper swing structure 12. The left side camera 201 is installed on the left side of the upper swing structure 12. The right side camera 202 is to photograph an image of a right side region S2 of the upper swing structure 12. The right side camera 202 is installed on the right side of the upper swing structure 12. The rear camera 203 is to photograph an image of a rear region S3 of the upper swing structure 12. The rear camera 203 is installed on the rear of the upper swing structure 12. Incidentally, as a camera for photographing an image of a front region of the upper swing structure 12, a front camera may be installed in front of the upper swing structure 12 and directly under the boom 8, for example.

As a controller in charge of various kinds of control of the hydraulic excavator 1, the controller 40 (see FIG. 4) is included in the upper swing structure 12. As will be described later in detail, the controller 40 according to the present embodiment is configured to be able to perform obstacle detection processing that detects an obstacle (moving body) present around the hydraulic excavator 1 on the basis of the images (camera images) photographed by the three cameras 201, 202, and 203. Incidentally, the controller 40 includes, as a hardware configuration thereof, an arithmetic processing device (for example, a CPU), a storage device (for example, a semiconductor memory such as a ROM or a RAM and a magnetic storage device such as a hard disk drive), and an interface (input-output device). The controller 40 outputs an arithmetic result as a signal from the interface, the arithmetic result being obtained by executing a program (software) stored within the storage device in advance by the arithmetic processing device.

Installed within the cab 106 provided to the front of the upper swing structure 12 are an operation device 47*a* (FIG. 4) for operating the right travelling hydraulic motor 3*a* (lower track structure 11), the operation device 47*a* having a right travelling lever 23*a* (FIG. 2); an operation device 47*b* (FIG. 4) for operating the left travelling hydraulic motor 3*b* (lower track structure 11), the operation device 47*b* having a left travelling lever 23*b* (FIG. 2); operation devices 45*a* and 46*a* (FIG. 4) for operating the boom cylinder 5 (boom 8) and the bucket cylinder 7 (bucket 10), the operation devices 45*a* and 46*a* sharing a right operation lever 22*a* (FIG. 2); and operation devices 45*b* and 46*b* (FIG. 4) for operating the arm cylinder 6 (arm 9) and the swing hydraulic motor 4 (upper swing structure 12), the operation devices 45*b* and 46*b* sharing a left operation lever 22*b* (FIG. 2). In the following, the right operation lever 22*a*, the left operation lever 22*b*, the right travelling lever 23*a*, and the left travelling lever 23*b* may be referred to collectively as control levers 22 and 23.

Provided on the left side of a cab seat within the cab 106 are a lock lever 401 switched to a switching position as one of a lock position that disables an operation by the control levers 22 and 23 and a lock release position that permits an operation by the control levers 22 and 23; and a lock lever sensor 116 that detects whether the switching position of the lock lever 401 is the lock position or the lock release position. The lock lever sensor 116 outputs a signal indicating switching position information (position) of the lock lever 401 to the controller 40. When this signal indicates the lock release position, the signal indicates a state in which an operator can operate operation targets including the lower track structure 11, the upper swing structure 12, and the front work device 1A. Conversely, when the lock position is indicated, a state is indicated in which the operator cannot operate the operation targets.

Provided on the right side of the cab seat within the cab 106 are a monitor 301 that displays, on the camera images, a position of an obstacle detected by the controller 40 on the basis of the camera images; and a speaker 302 as an alarm device that outputs an alarm when an alarm output command is input thereto from the controller 40. The monitor 301 and the speaker 302 can function as a notifying device that, when an obstacle is detected by the controller 40, makes a notification that the obstacle has been detected.

In FIG. 4, an engine 18 as a prime mover included in the upper swing structure 12 drives a hydraulic pump 2 and a pilot pump 48. The hydraulic pump 2 is a variable displacement pump whose displacement is controlled by a regulator 2*a*. The pilot pump 48 is a fixed displacement pump. In the present embodiment, as illustrated in FIG. 4, a shuttle block 162 is provided to midpoints of pilot lines 144*a*, 144*b*, 145*a*, 145*b*, 146*a*, 146*b*, 147*a*, 147*b*, 148*a*, 148*b*, 149*a*, and 149*b*. Hydraulic signals output from the operation devices 45, 46, and 47 are input also to the regulator 2*a* via the shuttle block 162. Though description of a detailed configuration of the shuttle block 162 will be omitted, the hydraulic signals are input to the regulator 2*a* via the shuttle block 162, and a delivery flow rate of the hydraulic pump 2 is controlled according to the hydraulic signals.

A pump line 150 as a delivery pipe of the pilot pump 48 passes through a lock valve 39, thereafter branches into a plurality of lines, and connects to respective valves within the operation devices 45, 46, and 47 and a front implement control hydraulic unit 160. The lock valve 39 in the present example is a solenoid control valve. A solenoid driving section of the lock valve 39 is electrically connected to the lock lever sensor 116 as a position sensor of the lock lever 401 disposed in the cab 106. The position of the lock lever 401 is detected by the lock lever sensor 116. A signal corresponding to the position of the lock lever 401 is input from the lock lever sensor 116 to the lock valve 39. When the position of the lock lever 401 is the lock position, the lock valve 39 is closed to interrupt the pump line 150. When the position of the lock lever 401 is the lock release position, the lock valve 39 is opened to open the pump line 150. That is, in a state in which the pump line 150 is interrupted, operations by the operation devices 45, 46, and 47 are disabled, and thus operations such as a swing and excavation are inhibited.

The operation devices 45, 46, and 47 are of a hydraulic pilot type. The operation devices 45, 46, and 47 generate pilot pressures (which may be referred to as operation pressures) corresponding to operation amounts (for example, lever strokes) and operation directions of the control levers 22 and 23 each operated by the operator on the basis of a hydraulic fluid delivered from the pilot pump 48. The thus generated pilot pressures are supplied to hydraulic drive sections 150*a* to 155*b* of corresponding flow control valves 15*a* to 15*f* via pilot lines 144*a* to 149*b*, and are used as control signals for driving these flow control valves 15*a* to 15*f*.

The pilot lines 144*a* to 149*b* are respectively provided with pressure sensors 70*a* to 75*b*. The pressure sensors 70*a* to 75*b* detect pilot pressures occurring in the respective pilot lines 144*a* to 149*b*, and output the pilot pressures to the controller 40. The pressure sensors 70*a* to 75*b* function as operation amount sensors of the operation devices 45, 46, and 47. In the following, the pressure sensors 70, 71, and 72 that detect the pilot pressures (operation amounts) of the hydraulic cylinders 5, 6, and 7 for driving the front work device 1A may be referred to collectively as a front implement operation measuring sensor 115, the pressure sensors 73 that detect the pilot pressure of the hydraulic motor 4 for driving the upper swing structure 12 may be referred to as a swing operation measuring sensor 114, and the pressure sensors 74 and 75 that detect the pilot pressures of the hydraulic motors 3*a* and 3*b* for driving the lower track structure 11 may be referred to collectively as a travelling operation measuring sensor 113.

A hydraulic fluid (hydraulic operating fluid) delivered from the hydraulic pump 2 is supplied to the right travelling hydraulic motor 3*a*, the left travelling hydraulic motor 3*b*, the swing hydraulic motor 4, the boom cylinder 5, the arm cylinder 6, and the bucket cylinder 7 via the flow control valves 15*a*, 15*b*, 15*c*, 15*d*, 15*e*, and 15*f*. When the boom cylinder 5, the arm cylinder 6, and the bucket cylinder 7 are driven to be expanded or contracted by the supplied hydraulic fluid, the boom 8, the arm 9, and the bucket 10 are individually rotated, and the position and posture of the bucket 10 thereby change. In addition, when the swing hydraulic motor 4 is rotationally driven by the supplied hydraulic fluid, the upper swing structure 12 swings with respect to the lower track structure 11. Then, when the right travelling hydraulic motor 3*a* and the left travelling hydraulic motor 3*b* are rotationally driven by the supplied hydraulic fluid, the lower track structure 11 travels. In the following, the travelling hydraulic motor 3, the swing hydraulic motor 4, the boom cylinder 5, the arm cylinder 6, and the bucket cylinder 7 may be referred to collectively as hydraulic actuators 3 to 7.

—Controller 40—

Figure 5:
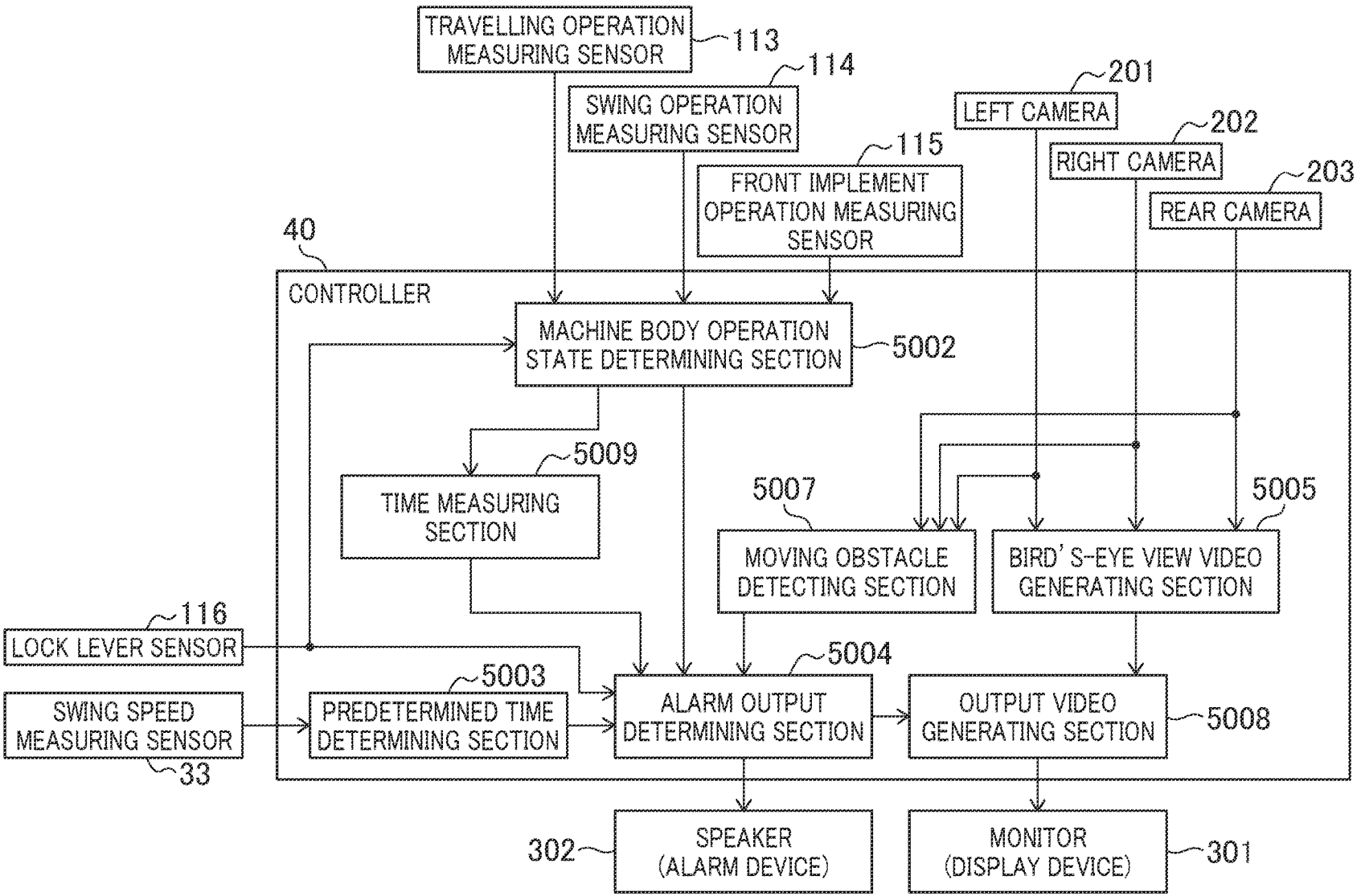
FIG. 5 is a functional block diagram of a controller 40 according to the embodiment of the present invention.

FIG. 5 is a system configuration diagram of the controller 40 and input-output devices related to the controller 40. Functions of a program implemented by the controller 40 are illustrated in a block diagram within the controller 40 in the figure.

The controller 40 is connected with the cameras 201, 202, and 203, the travelling operation measuring sensor 113, the swing operation measuring sensor 114, the front implement operation measuring sensor 115, the lock lever sensor 116, the swing speed measuring sensor 33, the monitor 301, and the speaker 302.

In addition, the controller 40 can obtain, from a sensor (not illustrated), information indicating the ON state/OFF state (ON/OFF information) of the engine 18 for driving the hydraulic pump 2 that supplies a hydraulic operating fluid to the plurality of hydraulic actuators 3 to 7 for driving the lower track structure 11, the upper swing structure 12, and the front work device 1A. The ON state/OFF state of the engine 18 may be determined from a position (an OFF position, an ON position, and a START position) of a key switch (not illustrated) used to ignite and stop the engine 18. The controller 40 is started when the key switch is changed from an OFF position to an ON position. Thereafter, the position of the key switch is output as a signal to the controller 40.

The controller 40 functions as a machine body operation state determining section 5002, a bird's-eye view video generating section 5005, a moving obstacle detecting section 5007, a time measuring section 5009, a predetermined time determining section 5003, an output video generating section 5008, and an alarm output determining section 5004.

The machine body operation state determining section 5002 receives detection signals (voltage values) from the measuring sensors 113, 114, and 115 and the lock lever sensor 116 and determines whether the operation devices 45, 46, and 47 (control levers 22 and 23) are either in an operating state or in a non-operating state, and determines whether the switching position of the lock lever 401 is either the lock position or the lock release position. The machine body operation state determining section 5002 outputs a result of the determination to the time measuring section 5009 and the alarm output determining section 5004.

Figure 7:
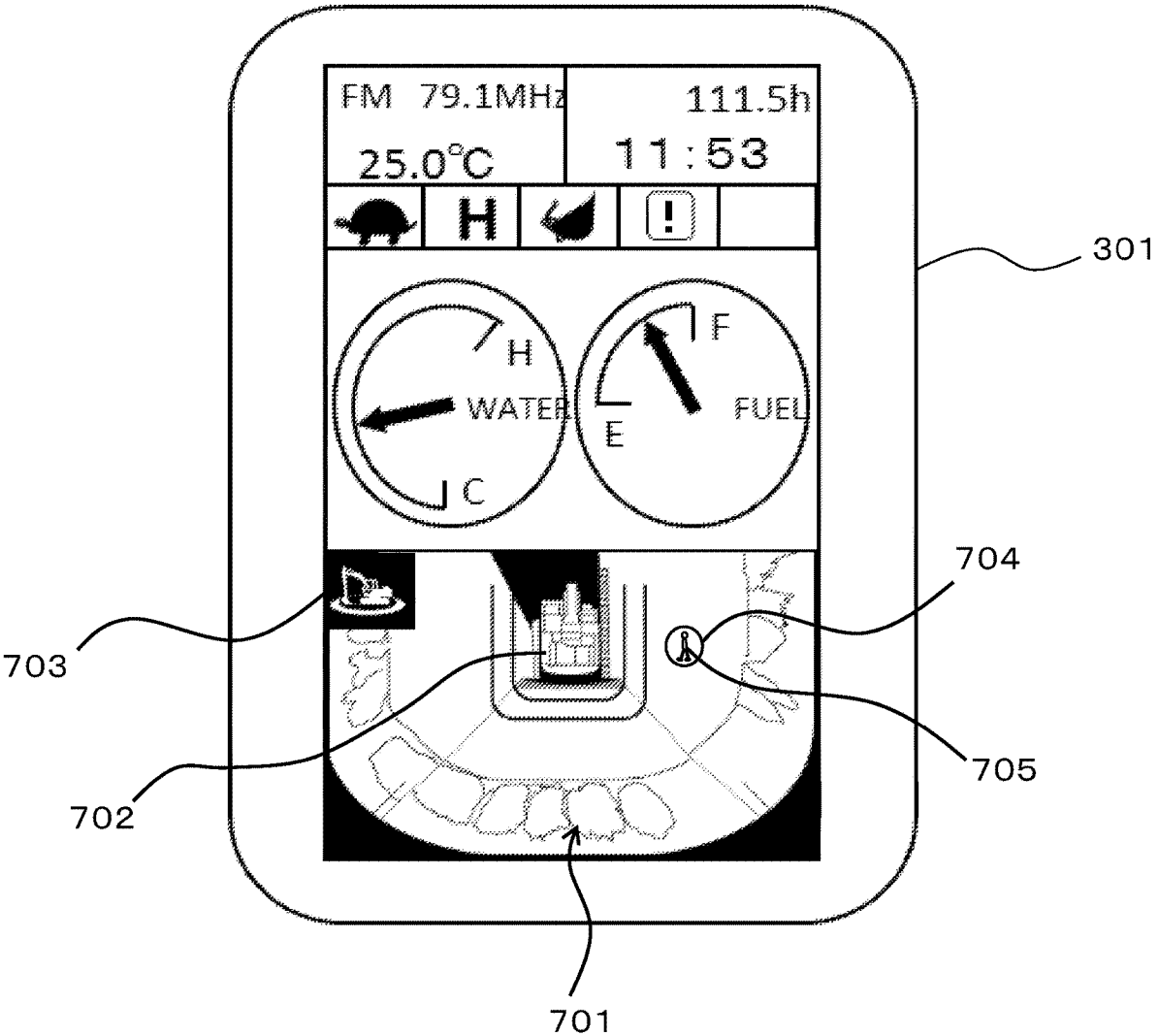
FIG. 7 is a diagram illustrating an example of a display screen of a monitor 301 according to the embodiment of the present invention.

The bird's-eye view video generating section 5005 is a part that performs processing of generating bird's-eye view video 701 (see FIG. 7) with the hydraulic excavator 1 at a center on the basis of the video (time series data of still images) of the regions S1, S2, and S3 photographed by the cameras 201, 202, and 203, and outputting the bird's-eye view video to the output video generating section 5008. FIG. 7 illustrates an example of a screen of the monitor 301. As illustrated in this figure, the bird's-eye view video 701 refers to video corresponding to a plan view obtained when a reference point is set at a swing center of the hydraulic excavator 1, for example, and a work site is viewed from a position directly above the reference point (that is, directly above the hydraulic excavator). In the present embodiment, the bird's-eye view video 701 is generated by converting and combining the video of the three cameras 201, 202, and 203. An icon 702 schematically illustrating a top view of the hydraulic excavator 1 is disposed at a center of the bird's-eye view video 701 in FIG. 7.

The moving obstacle detecting section 5007 is a part that performs processing of detecting a moving obstacle from a luminance change in each pixel in each frame on the basis of the video (time series data of still images) of the regions S1, S2, and S3 photographed by the cameras 201, 202, and 203, and storing coordinates of the detected moving obstacle on the bird's-eye view video and outputting the coordinates to the alarm output determining section 5004.

The detection of the moving obstacle by the moving obstacle detecting section 5007 can be performed as follows, for example. Specifically, first, the time series data of input images from the cameras 201, 202, and 203 which images immediately precede or precede by n frames and an image obtained by separately photographing a state in which there is no obstacle or the like are input as a background image. Then, a difference image of each pixel is generated using the time series data of input images and the background image, and an obstacle change region is extracted by performing binarization processing that sets, to zero, a part whose luminance is less than a predetermined threshold value in the generated difference image and sets, to one or more, a part whose luminance is equal to or more than the predetermined threshold value in the generated difference image. Whether or not the extracted change region has a part whose area is equal to or more than a predetermined threshold value is next determined. It is determined that there is an obstacle region when the change region has a part whose area is equal to or more than the threshold value. It is determined that there is no obstacle when the change region has only a part whose area is less than the threshold value.

The time measuring section 5009 is a part that performs processing of measuring a time (non-operation duration) T2 for which a non-operating state of the operation devices 45, 46, and 47 (control levers 22 and 23) is continued on the basis of the determination result of the machine body operation state determining section 5002, and outputting the result to the alarm output determining section 5004. An initial value of the non-operation duration T2 at the time of a start of the controller 40 (that is, at the time of changing the key switch from the OFF position to the ON position) is set at a value (for example, ∞) larger than a predetermined time (non-operation continuation necessary time) T1 to be described later, and it is configured such that a determination of YES is always made in S615 in FIG. 6B to be described later (that is, such that the processing proceeds to S616) when the operation devices 22 and 23 are in a non-operating state at the time of a start of the engine. The time measuring section 5009 resets the measurement of the non-operation duration T2 when the operation devices 45, 46, and 47 change from the non-operating state to an operating state.

The predetermined time determining section 5003 is supplied with a swing speed (angular velocity) of the upper swing structure 12 from the swing speed measuring sensor (IMU) 33, performs processing of calculating the predetermined time (non-operation continuation necessary time) T1 on the basis of the swing speed, and outputs the result to the alarm output determining section 5004. The predetermined time (non-operation continuation necessary time) T1 is a duration of a non-operating state which duration is necessary to permit a notification by the speaker 302 when the lock lever 401 is at the lock release position and the operation devices 45, 46, and 47 are changed from an operating state to a non-operating state.

Figure 9:
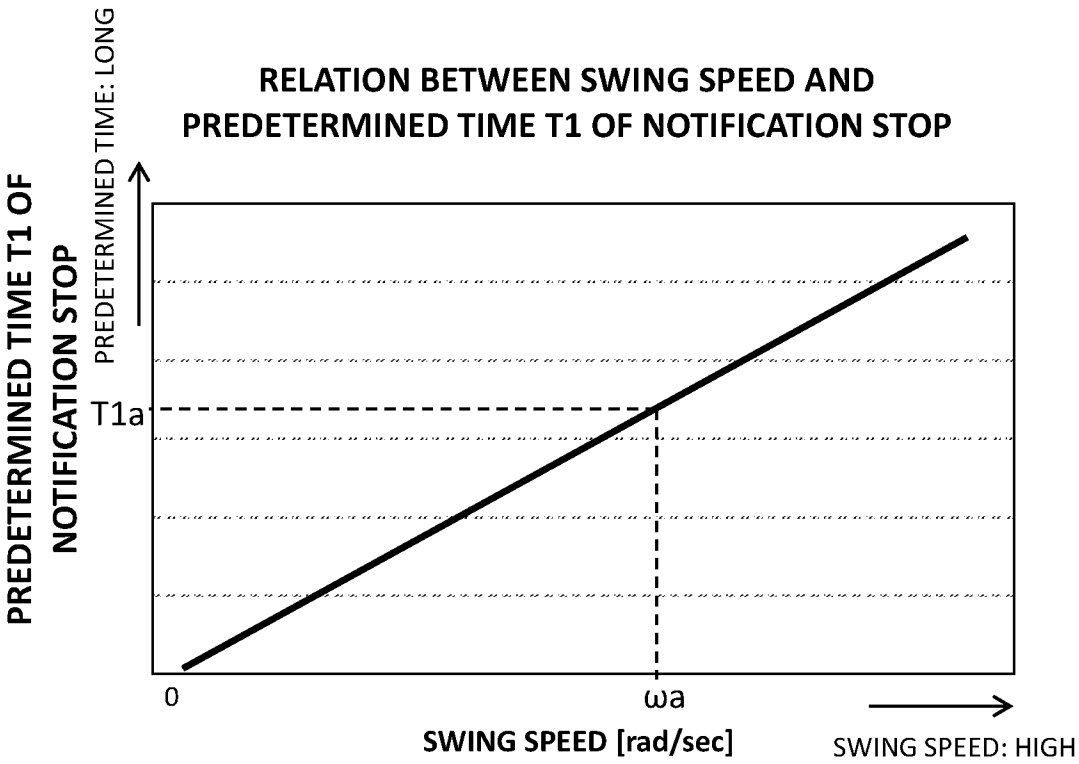
FIG. 9 is a diagram illustrating an example of a table that defines a relation between a swing speed and a predetermined time T1 according to the embodiment of the present invention.

The predetermined time determining section 5003 in the present embodiment calculates the predetermined time (non-operation continuation necessary time) T1 from the swing speed on the basis of a table illustrated in FIG. 9. As illustrated in this figure, a relation between the swing speed and the predetermined time T1 is set such that the predetermined time T1 monotonically increases with increase in the swing speed. Incidentally, while the swing speed and the predetermined time T1 are in directly proportional relation to each other in the example of FIG. 9, another relation may be defined by a curve, a step graph, or the like as long as the swing speed and the predetermined time T1 are in such a relation that the predetermined time T1 monotonically increases with increase in the swing speed.

In addition, while the value of the predetermined time T1 is zero when the swing speed is zero in the example of FIG. 9, the value of the predetermined time T1 may be set to a value larger than zero, and the predetermined time T1 may be set so as to monotonically increase with increase in the swing speed. As for a policy for setting the magnitude of the predetermined time T1 at the time at which the swing speed is zero, the upper swing structure 12 may vibrate due to the operation of the front work device 1A and the operation of the lower track structure 11 when an operation other than a swing operation is input by the control levers 22 and 23, and the predetermined time T1 is preferably set at a value larger than a maximum time taken for the vibration to be stopped in the case of changing the control levers 22 and 23 from an operating state to a non-operating state (neutral position).

The output video generating section 5008 is a part that performs processing of generating video to be output to the monitor 23 on the basis of the coordinates of the detected moving obstacle on the bird's-eye view video 701, the detected moving obstacle being detected by the moving obstacle detecting section 5007, and the bird's-eye view video 701 generated by the bird's-eye view video generating section 5005. The output video generating section 5008 indicates a position at which the moving obstacle is present on the bird's-eye view video 701. A person 705 as the moving obstacle is photographed on the bird's-eye view video 701 on the monitor 301 in FIG. 7. When the moving obstacle detecting section 5007 detects this person 705 as the moving obstacle, the output video generating section 5008 displays a figure (circle in the example of FIG. 7) 704 indicating that the moving obstacle is present at the position of the person 705 on the basis of the coordinates calculated by the moving obstacle detecting section 5007. The display and non-display of the FIG. 704 can be changed by a setting.

The alarm output determining section 5004 is a part that determines whether or not to output an alarm by the speaker 302 on the basis of the non-operation duration T2 and the predetermined time T1, the detection signal of the lock lever sensor 116 (the switching position of the lock lever 401), and a result of detection of the moving obstacle by the moving obstacle detecting section 5007, and controls a sound output by the speaker 302 on the basis of a result of the determination. When the alarm output determining section 5004 determines that an alarm is to be output, a notification flag in a flowchart to be described later (see FIG. 6A and FIG. 6B) is set to ON. When the alarm output determining section 5004 determines that an alarm is not to be output, the notification flag is set to OFF.

—Flowchart of Processing by Controller 40—

Figure 6A:
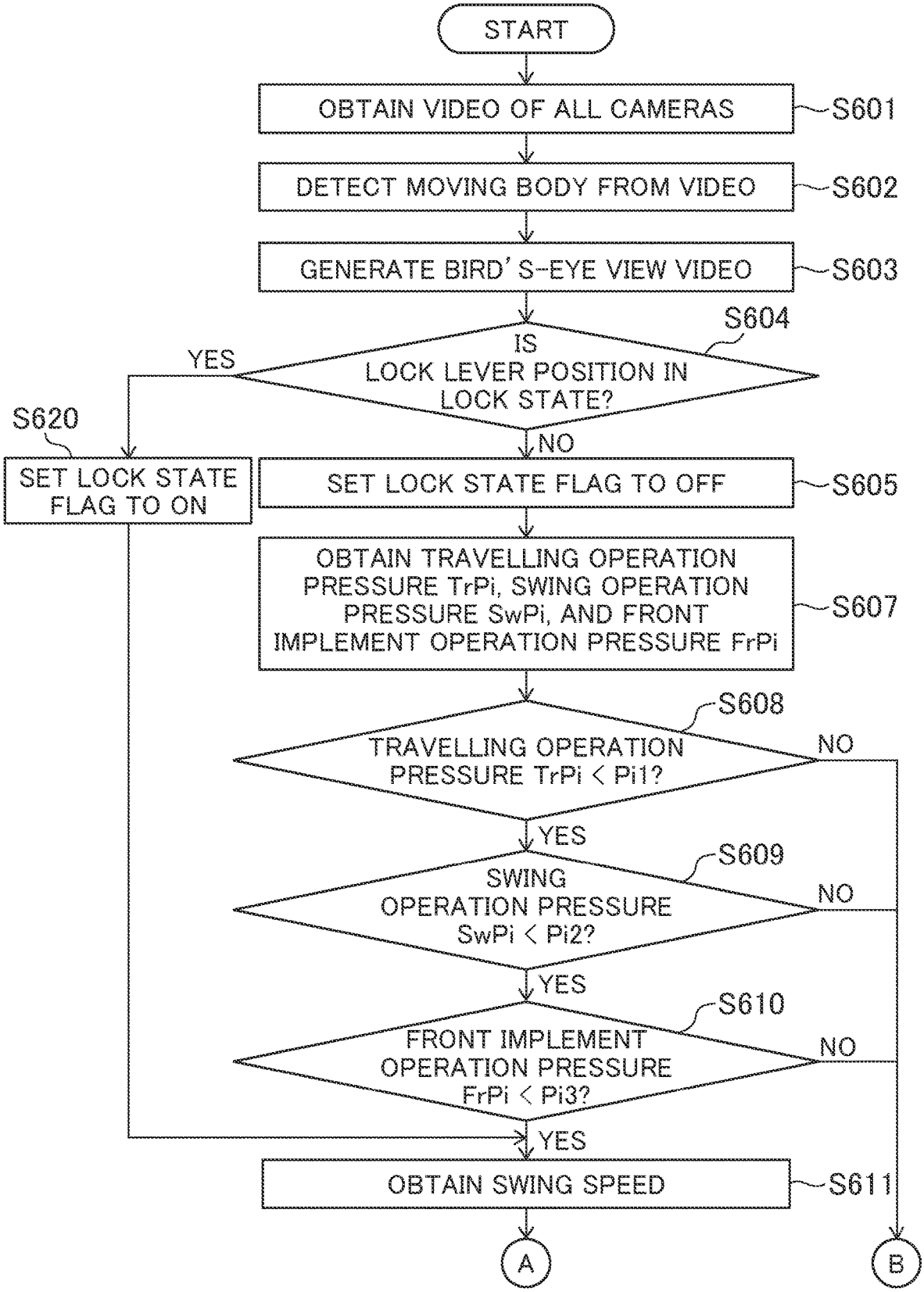
FIG. 6A is a control flowchart of the controller 40 according to the embodiment of the present invention.
Figure 6B:
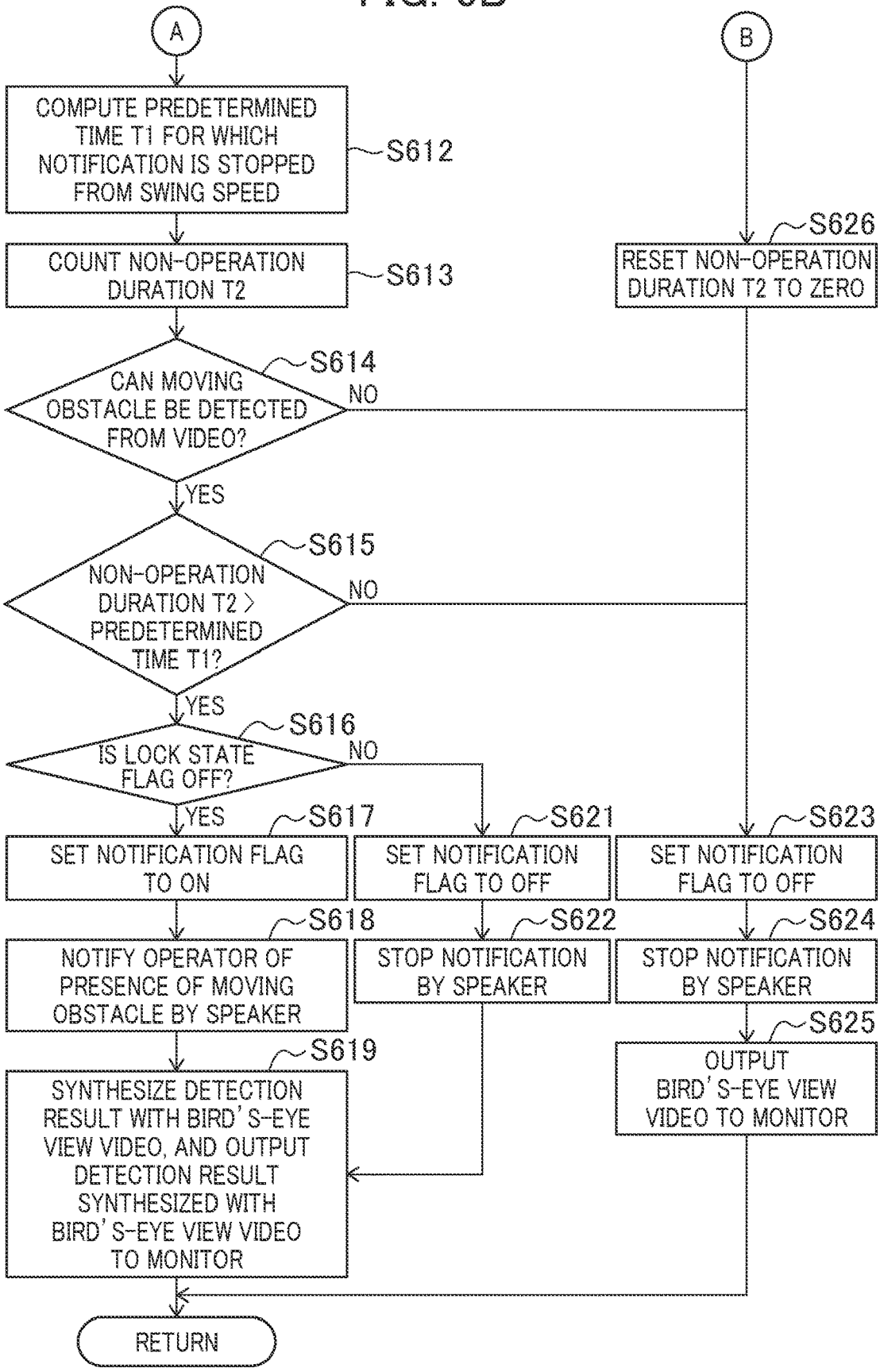
FIG. 6B is a control flowchart of the controller 40 according to the embodiment of the present invention.

FIG. 6A and FIG. 6B represent a flowchart of internal processing of the controller 40 according to the embodiment of the present invention. Steps provided with reference symbols A and B in FIG. 6A are connected to steps provided with the same reference symbols A and B in FIG. 6B.

When the key switch is switched from the OFF position to the ON position, and the controller 40 is started, the cameras 201, 202, and 203 start video recording, and processing is performed in order of the flowchart.

In S601, the controller 40 (the moving obstacle detecting section 5007 and the bird's-eye view video generating section 5005) obtains the videos of all of the cameras 201, 202, and 203.

In S602, the controller 40 (the moving obstacle detecting section 5007) detects presence or absence of a moving obstacle on the basis of the videos obtained in S601, stores a result of the detection, and stores coordinates of the moving obstacle on the bird's-eye view video 701 when the moving obstacle is detected.

In S603, the controller 40 (the bird's-eye view video generating section 5005) generates the bird's-eye view video 701 on the basis of the videos obtained in S601.

In S604, the controller 40 (the machine body operation state determining section 5002) determines whether or not the position of the lock lever 401 is the lock position on the basis of the signal of the lock lever sensor 116. When it is determined here that the lock lever 401 is at the lock position, a lock state flag is set to ON (S620), and the processing proceeds to S611. When it is determined that the lock lever 401 is at the lock release position, on the other hand, the lock state flag is set to OFF (S605), and the processing proceeds to S607.

In S607, the controller 40 (the machine body operation state determining section 5002) obtains a travelling operation pressure TrPi, a swing operation pressure SwPi, and a front implement operation pressure FrPi from the travelling operation measuring sensor 113, the swing operation measuring sensor 114, and the front implement operation measuring sensor 115. The controller 40 (the machine body operation state determining section 5002) determines whether or not the operation pressures TrPi, SwPi, and FrPi obtained in S607 are equal to or less than respective operation determination threshold values Pi1, Pi2, and Pi3 in S608, S609, and S610. When one of the operation pressures TrPi, SwPi, and FrPi exceeds the corresponding threshold value Pi1, Pi2, or Pi3 as a comparison target, the processing proceeds to S626 (see FIG. 6B). When all of the operation pressures TrPi, SwPi, and FrPi are equal to or less than the respective threshold values Pi1, Pi2, and Pi3, the processing proceeds to S611.

In S626 (see FIG. 6B), the controller 40 (the time measuring section 5009) resets the non-operation duration T2 to zero. The controller 40 then proceeds to S623.

In S611 (see FIG. 6A), the controller 40 (the predetermined time determining section 5003) calculates the swing speed from the signal of the swing speed measuring sensor 33. The controller 40 then proceeds to S612 (see FIG. 6B).

In S612, the controller 40 (the predetermined time determining section 5003) calculates the predetermined time T1 by using the swing speed obtained in S611 and the table of FIG. 9. The controller 40 then proceeds to S613.

In S613, the controller 40 (the time measuring section 5009) counts the non-operation duration T2. The controller 40 then proceeds to S614. When S613 is reached in a state in which the non-operation duration T2 is zero, the controller 40 (the time measuring section 5009) starts to count the non-operation duration T2. When S613 is reached in a state in which the non-operation duration T2 is other than zero, the controller 40 (the time measuring section 5009) continues counting the non-operation duration T2. Incidentally, when the non-operation duration T2 is other than zero, that is, when the non-operating state of the operation devices 45, 46, and 47 is continued, the output video generating section 5008 may display an icon 703 (see FIG. 7) that indicates the non-operating state of the operation devices 45, 46, and 47 has been continued, on the screen of the monitor 23.

In S614, the controller 40 (the alarm output determining section 5004) determines whether or not a moving obstacle can be detected from the videos (time series data of camera images) taken by the cameras 201, 202, and 203 in the obstacle detection processing of the moving body obstacle detecting section 5007 in S602. When at least one moving obstacle is detected, the processing proceeds to S615. When no moving obstacle is detected, the processing proceeds to S623.

In S615, the controller 40 (the alarm output determining section 5004) determines whether or not the non-operation duration T2 counted in S613 exceeds the predetermined time T1 determined in S612. When the non-operation duration T2 exceeds the predetermined time T1, the processing proceeds to S616. When the non-operation duration T2 is equal to or less than the predetermined time T1, the processing proceeds to S623.

In S616, the controller 40 (the alarm output determining section 5004) determines whether or not the lock state flag set in S603 or S604 is set to OFF. Here, when the lock state flag is OFF, the processing proceeds to S617. When the lock state flag is ON, the processing proceeds to S621.

In S617, the controller 40 (the alarm output determining section 5004) sets the notification flag to ON, and permits an output of alarm sound by the speaker 302. Consequently, alarm sound is output from the speaker 302, and the presence of the moving obstacle is notified to the operator of the hydraulic excavator 1 (S618). The processing is then shifted to S619.

In S621, the controller 40 (the alarm output determining section 5004) sets the notification flag to OFF, and inhibits the output of the alarm sound by the speaker 302. Consequently, the output of the alarm sound from the speaker 302 is stopped, or a state in which the output of the alarm sound from the speaker 302 is stopped is continued (S622). The processing is then shifted to S619.

In S623, the controller 40 (the alarm output determining section 5004) sets the notification flag to OFF, and inhibits the output of the alarm sound by the speaker 302. Consequently, the output of the alarm sound from the speaker 302 is stopped, or a state in which the output of the alarm sound from the speaker 302 is stopped is continued (S624). The processing is then shifted to S625.

In S619, the controller 40 (the output video generating section 5008) synthesizes the result of detection of the moving obstacle (FIG. 704) with the bird's-eye view video 701, and outputs the detection result synthesized with the bird's-eye view video 701 to the monitor 23. The controller 40 then returns to the first processing S601.

In S625, the controller 40 (the output video generating section 5008) outputs only the bird's-eye view video 701 to the monitor 23 without synthesizing the result of detection of the moving obstacle (FIG. 704) with the bird's-eye view video 701. The controller 40 then returns to the first processing S601.

—Operations and Effects—

Figure 8:
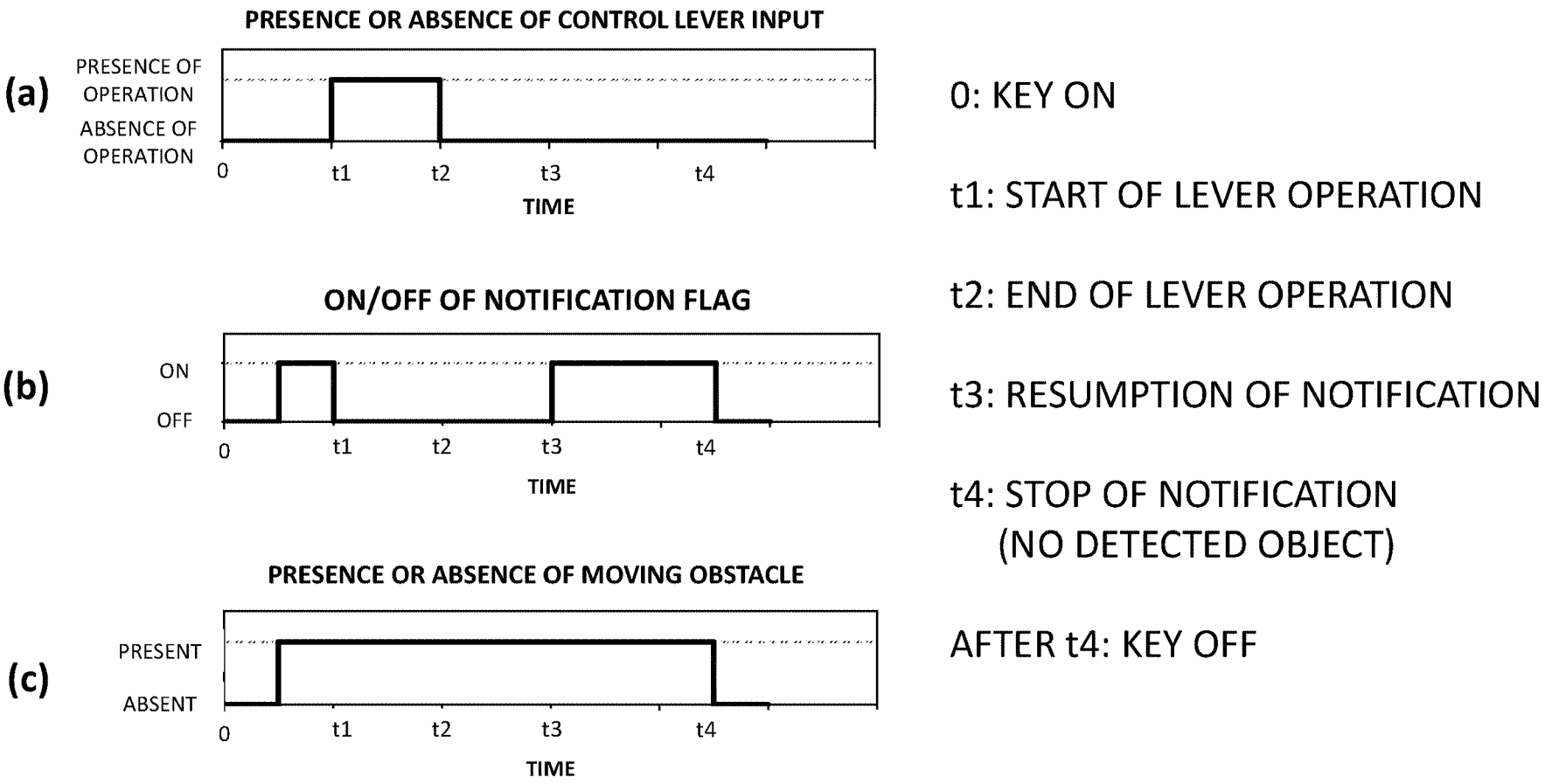
FIG. 8 is a diagram illustrating an example of timing diagrams of presence or absence of an operating input to control levers, ON/OFF of a notification flag, and presence or absence of a moving obstacle.

Operations and effects of the hydraulic excavator 1 configured as described above will be described on the basis of conditions illustrated in FIG. 8. A diagram illustrated in (a) as a top part of FIG. 8 is a timing diagram illustrating presence or absence of an input to the control levers 22 and 23 (operating state/non-operating state). A diagram illustrated in (b) as a middle part of FIG. 8 is a timing diagram illustrating ON/OFF changes of the notification flag by the alarm output determining section 5004. A diagram illustrated in (c) as a bottom part of FIG. 8 is a timing diagram illustrating presence or absence of a moving obstacle within angle-of-views of the cameras 201, 202, and 203. As illustrated on the right side of FIG. 8, a situation is assumed in which the key switch is switched from the OFF position to the ON position at time 0, an operation of the control levers 22 and 23 is started at time t1, the operation of the control levers 22 and 23 is ended at time t2, and the key switch is switched from the ON position to the OFF position at or after time t4. In this case, as illustrated in (c), the moving obstacle appears within the angle-of-views of the cameras 201, 202, and 203 during a period from time 0 to time t1, and is thereafter outside the angle-of-views of the cameras 201, 202, and 203 at time t4.

(1) Time 0

The controller 40 is started when the operator switches the key switch of the hydraulic excavator 1 from the OFF position to the ON position at time 0. When the engine 18 is next started by switching the key switch from the ON position to the START position, the key switch is immediately maintained in the ON position. Then, immediately thereafter, the operator switches the lock lever 401 from the lock position to the lock release position. At this time, the moving obstacle is not present within the angle-of-views of the cameras 201, 202, and 203. Thus, the processing of the controller 40 proceeds from S614 to S623 of the flowchart of FIG. 6A and FIG. 6B, so that the notification flag is set to OFF and the notification by the speaker 302 is not made.

(2) Period from Time 0 to Time t1

The control levers 22 and 23 are maintained in a non-operating state also afterward. When the moving obstacle appears within the range of the cameras 201, 202, and 203 during a period from time 0 to time t1, the processing of the controller 40 proceeds from S615 to S616 because the non-operation duration T2 is counted from an initial value (for example, ∞) and is more than the predetermined time T1. At this time, the lock lever 401 is switched to the lock release position. That is, the lock state flag is set to OFF. The processing therefore further proceeds to S617, where the notification flag is set to ON. Thus, the notification by the speaker 302 is made (S618), and the FIG. 704 indicating the position of the moving obstacle is displayed on the bird's-eye view video on the monitor 301 (S619). As a result, the operator can easily recognize the presence of the moving obstacle on the basis of the alarm of the speaker 302 and the video of the monitor 301 at a timing at which it is necessary to check surroundings of the machine body before a start of work.

(3) Time t1

When the control levers 22 and 23 are thereafter changed to an operating state at time t1, the processing of the controller 40 proceeds to S626 (see FIG. 6B), where the non-operation duration T2 is reset to zero, and the notification flag is set to OFF (S623). Thus, though the moving obstacle is present in the angle-of-views of the cameras 201, 202, and 203, the notification by the speaker 302 is stopped (S624), and the FIG. 704 indicating the position of the moving obstacle is removed from the bird's-eye view video on the monitor 301 (S625). In this case, the operator has already recognized the presence of the moving obstacle on the basis of the alarm of the speaker 302 and the video of the monitor 301 before time t1. Thus, an unnecessary notification can be prevented from being issued, and the operator does not feel annoyed. In addition, during the operation of the control levers 22 and 23, the upper swing structure 12 to which the cameras 201, 202, and 203 are attached is highly likely to be swung or vibrated by the operation. Therefore, when a method of detecting the moving obstacle from luminance changes in pixels of each frame of the bird's-eye view video is used in detecting the moving obstacle as in the present embodiment, unnecessary detection of the moving obstacle may be increased, and the operator may feel annoyed. However, such an unnecessary notification of the moving obstacle can be avoided when the notification flag is set to OFF during the operation of the control levers 22 and 23 as in the present embodiment.

(4) Time t2

When the control levers 22 and 23 are changed from the operating state to a non-operating state at time t2, the processing of the controller 40 proceeds to S611 and S612, and the predetermined time T1 is calculated on the basis of the swing speed of the upper swing structure 12. For example, if a swing operation is input via the control lever 22*b* from time t1 to immediately before time t2 and the swing speed of the upper swing structure 12 at time t2 is ωa (see FIG. 9), Tia (see FIG. 9) is calculated as the predetermined time T1. The processing of the controller 40 at this time proceeds to S615. However, the non-operation duration T2 is substantially zero and is smaller than the predetermined time Tia immediately after the non-operation duration T2 starts to be counted. Therefore, the notification flag is still maintained in an OFF state (S623), and as for the notification by the speaker 302 and the monitor 301, states immediately before time t2 are maintained. Thereafter, with the passage of time, the swing speed of the upper swing structure 12 approaches zero from ωa, and thus the predetermined time T1 also similarly approaches zero.

(5) Time t3

At time t3, the non-operation duration T2 has become more than the predetermined time T1 (that is, the upper swing structure 12 has become stationary). Thus, the processing of the controller 40 proceeds from S615 through S616 to 617, where the notification flag is set to ON again. That is, a return is made to the state immediately before time t1 at which the operation of the control levers 22 and 23 is started. Thus, the notification by the speaker 302 is permitted (S618), and the display of the FIG. 704 indicating the position of the moving obstacle on the bird's-eye view video on the monitor 301 is also permitted (S619). At this time, because the upper swing structure 12 is stationary, unnecessary detection of the moving obstacle is not performed, and the operator does not feel annoyed. In addition, when the moving obstacle is present within the angle-of-views of the cameras 201, 202, and 203 at time t3 as in the example of FIG. 8, the operator can easily recognize the presence of the moving obstacle on the basis of the alarm of the speaker 302 and the video of the monitor 301.

(6) Others

Though not mentioned in the above description, if the moving obstacle is detected and the non-operation duration T2 exceeds the predetermined time T1 when the lock lever 401 is at the lock position, the processing of the controller 40 proceeds through S616 to S621, where the notification flag is set to OFF. In this case, in the present embodiment, the alarm of the speaker 302 is stopped (S622), but the position of the moving obstacle is displayed on the monitor 301 (S619). Assumed as specific situations in which the lock lever 401 is switched to the lock position while the operator is within the cab 106 are situations in which the operator takes a break or checks work, for example, within the cab 106, except at the time of a start of the controller (at the time of turning the key ON). When the alarm of the speaker 302 is output in such situations, there is a strong possibility of the alarm of the speaker 302 disturbing the operator taking a break or checking work, for example, and the alarm of the speaker 302 tends to be an unnecessary notification for the operator. However, a configuration as in the present embodiment can prevent the unnecessary notification from being made.

Summary

As described above, in the hydraulic excavator 1 according to the present embodiment, if the lock lever 401 is at the lock release position and the operation devices 45, 46, and 47 (control levers 22 and 23) are maintained in a non-operating state from a time of a start of the controller 40, the controller 40 permits a notification by the speaker (notifying device) 302. If the lock lever 401 is at the lock release position and the operation devices 45, 46, and 47 (control levers 22 and 23) are changed from an operating state to a non-operating state, the controller 40 permits the notification by the speaker (notifying device) 302 when the non-operating state is continued for the predetermined time T1. The operator can thereby easily recognize the presence of the moving obstacle on the basis of the notification by the speaker 302 at a timing at which it is necessary to check surroundings of the machine body after a start of the controller 40 and before a start of work. Further, in the case of returning the operation devices 45, 46, and 47 (control levers 22 and 23) from an operating state to a non-operating state, the notification by the speaker 302 is made after the upper swing structure 12 becomes stationary. It is therefore possible to prevent unnecessary notifications to the operator, and prevent the operator from feeling annoyed.

<Others>

It is to be noted that the present invention is not limited to the foregoing embodiment and includes various modifications within a scope not departing from the spirit of the present invention. For example, the present invention is not limited to including all of the configurations described in the foregoing embodiment and includes configurations obtained by omitting a part of the configurations. In addition, a part of a configuration according to a certain embodiment can be added to or replaced with a configuration according to another embodiment.

In the above description, the predetermined time T1 is calculated on the basis of the swing speed at the time. However, a preset value may be used as the predetermined time T1 regardless of the magnitude of the swing speed. In this case, for example, a time taken for the upper swing structure 12 to become stationary from a time at which a swing operation by the control lever 22*b* is stopped when the swing speed is at a maximum is measured, and the time can be set as the predetermined time T1. In addition, a configuration may be adopted in which the predetermined time T1 is determined from the swing speed at a certain timing (for example, when the control levers 22 and 23 are changed from an operating state to a non-operating state).

In addition, while the predetermined time T1 is determined from the swing speed in the above description, pitching (longitudinal vibration) and rolling (lateral vibration) of the upper swing structure 12 due to the operation of the control levers 22 and 23 may be detected by the IMU, and the predetermined time T1 may be determined on the basis of a time taken before the pitching (longitudinal vibration) and the rolling (lateral vibration) attenuate and the upper swing structure 12 becomes stationary.

In addition, while the ON/OFF of output of the alarm sound by the speaker 302 is controlled on the basis of the ON/OFF of the notification flag in the above description, the ON/OFF of display of the position of the moving obstacle on the monitor 301 may be controlled instead. That is, the monitor 301 may be used as the notifying device in place of the speaker 302.

In addition, a part or the whole of each configuration of the controller 40 described above and functions, execution processing, and the like of each such configuration may be implemented by hardware (for example, by designing logic for performing each function by an integrated circuit). In addition, the configurations of the controller 40 described above may be a program (software) that implements each function of the configurations of the controller 40 by being read and executed by an arithmetic processing device (for example, a CPU). Information related to the program can be stored in, for example, a semiconductor memory (a flash memory, an SSD, or the like), a magnetic storage device (a hard disk drive or the like), a recording medium (a magnetic disk, an optical disk, or the like), and the like.

In addition, in the description of each of the foregoing embodiments, control lines and information lines construed as necessary for the description of the embodiments are illustrated. However, not all of control lines and information lines of a product are necessarily illustrated. Almost all configurations may be considered to be actually interconnected.

DESCRIPTION OF REFERENCE SYMBOLS

1: Hydraulic excavator
1A: Front work device
1B: Machine body (machine main body)
2: Hydraulic pump
3 to 7: Hydraulic actuator
11: Lower track structure
12: Upper swing structure
18: Engine
22: Control lever
23: Control lever
33: Swing speed measuring sensor (IMU)
40: Controller
45 to 47: Operation device
70 to 75: Pressure sensor
106: Cab
113: Travelling operation measuring sensor
114: Swing operation measuring sensor
115: Front implement operation measuring sensor
116: Lock lever sensor
201 to 203: Camera
301: Monitor (notifying device)
302: Speaker (notifying device)
401: Lock lever
701: Bird's-eye view video

The invention claimed is:

1. A hydraulic excavator comprising:

a lower track structure;

an upper swing structure swingably attached to an upper portion of the lower track structure;

a front work device attached to the upper swing structure;

an operation device that operates operation targets including the lower track structure, the upper swing structure, and the front work device;

a lock lever switched to one of a lock position that disables an operation of the operation targets by the operation device and a lock release position that permits the operation of the operation targets by the operation device;

a camera that is attached to the upper swing structure and records a video of surroundings of the upper swing structure, the video including time series data of still images recorded by the camera;

a controller configured to detect a presence or absence of an obstacle around the upper swing structure based on a luminance change in each pixel of each still image recorded by the camera; and a notifying device that makes a notification that the obstacle is detected when the controller detects the obstacle, wherein the controller is configured to permit the notification by the notifying device when the lock lever is at the lock release position and when the operation device is maintained in a non-operating state from a time of a start of the controller and, when the lock lever is at the lock release position and when the operation device is changed from an operating state to a non-operating state, permit the notification by the notifying device upon the non-operating state being continued for a predetermined time.

2. The hydraulic excavator according to claim 1, wherein the predetermined time is determined on a basis of a time taken for the upper swing structure to become stationary from a time at which the operation device is changed from the operating state to the non-operating state.

3. The hydraulic excavator according to claim 1, wherein the notifying device is at least one of a monitor that displays a position of the obstacle detected by the controller and an alarm device that outputs an alarm when the controller detects the obstacle.

4. The hydraulic excavator according to claim 1, further comprising:

a speed sensor that detects a swing speed of the upper swing structure, wherein the controller is configured to determine the predetermined time on a basis of the swing speed of the upper swing structure, the swing speed being detected by the speed sensor.

5. The hydraulic excavator according to claim 1, wherein the controller is configured to inhibit the notification by the notifying device when the lock lever is at the lock release position and when the operation device is in an operating state.

6. The hydraulic excavator according to claim 1, wherein the controller is configured to determine whether a state of the operation device is either an operating state or a non-operating state on a basis of a detection signal of an operation amount sensor that detects an operation amount of the operation device, and determine whether a switching position of the lock lever is either the lock position or the lock release position on a basis of a detection signal of a lock lever sensor that detects the switching position of the lock lever.

* * * * *